US005928380A

United States Patent [19]

Winkler et al.

[11] Patent Number: 5,928,380

[45] Date of Patent: Jul. 27, 1999

[54] TREATMENT OF FABRICS GARMENTS OR YARNS WITH HALOPEROXIDASE

[75] Inventors: Jacob Winkler, Copenhagen; Lars Sparre Conrad, Brønshøj, both of Denmark

[73] Assignee: Novo Nordisk A/S, Bagsvaerd, Denmark

[21] Appl. No.: 09/093,103

[22] Filed: Jun. 8, 1998

Related U.S. Application Data

[60] Provisional application No. 60/049,071, Jun. 10, 1997.

[30] Foreign Application Priority Data

Jun. 9, 1997 [DK] Denmark ..... 0673/97

[51] Int. Cl.[6] ..... D06M 16/00

[52] U.S. Cl. ..... 8/107; 8/111; 8/137; 8/128.1; 8/128.3; 8/116.1; 8/181; 435/263

[58] Field of Search ..... 8/107, 111, 137, 8/128.1, 128.3, 116.1, 181; 435/263

[56] References Cited

U.S. PATENT DOCUMENTS 5,458,810 10/1995 Fredj et al. ..... 510/320

FOREIGN PATENT DOCUMENTS

| | | |
|---|---|---|
| WO 89/09813 | 10/1989 | WIPO . |
| WO 93/11226 | 6/1993 | WIPO . |
| WO 97/04102 | 2/1997 | WIPO . |
| WO 98/27264 | 6/1998 | WIPO . |

*Primary Examiner*—Alan Diamond
*Attorney, Agent, or Firm*—Steve T. Zelson, Esq.; Valeta Gregg, Esq.

[57] ABSTRACT

A method of treating fabrics, garments, or yarns comprising treating undyed fabric, garment, or yarn in an aqueous medium with an effective amount of a haloperoxidase, a halide source, and a hydrogen peroxide source. The treated fabric, garment, or yarn exhibits improved characteristics relative to untreated fabric, garment, or yarn, such as improved shrink-resistance.

16 Claims, No Drawings

TREATMENT OF FABRICS GARMENTS OR YARNS WITH HALOPEROXIDASE

CROSS-REFERENCE TO RELATED APPLICATIONS

This application claims priority under 35 U.S.C. 119 of Danish application Ser. No. 0673/97 filed Jun. 9, 1997 and U.S. Provisional application No. 60/049,071 filed Jun. 10, 1997, the contents of which are fully incorporated herein by reference.

FIELD OF THE INVENTION

The present invention relates to a new method of treating undyed fabrics, garments, or yarn comprising treating the undyed fabric, garment, or yarn in an aqueous medium with a haloperoxidase, a halide source and a hydrogen peroxide source.

BACKGROUND OF THE INVENTION

Textiles composed of materials such as wool, and in particular, cellulosics such as cotton, are frequently bleached during manufacturing. Hydrogen peroxide is often used as a bleaching agent. In addition to hydrogen peroxide, the bleaching solutions will normally contain silicates, caustic agents, chelators, organic stabilizers, magnesium salts, and wetting agents. The bleaching treatment has two primary functions; the first is to obtain a high level of whiteness, and the second (when the textile is a cellulosic material) is to break down and solubilize mote materials. Typical bleaching conditions are 0.5–1.5% hydrogen peroxide, 0.5–2% sodium silicate, 0.1–0.4% caustic, and 0.2% chelators at a temperature of 100° C. WO 92/18683 describes a process for bleaching dyed textiles with peroxidases and oxidases.

Furthermore, fabrics, garments, or yarns are sometimes treated in order to improve dyeing characteristics such as dye uptake.

Furthermore, fabrics, garments, or yarns of woll or other animal hair fibers are sometimes treated in order to protect against the tendency to shrink. Methods to generate shrink-resistant fabrics, garments, or yarns are known. The most commonly used method for wool is the IWS/CSIRO Chlorine Hercosett process, which comprises an acid chlorination of wool, followed by a polymer application. This process imparts a high degree of shrink-resistance to wool, but adversely affects the handle of wool, and generates environmentally damaging waste. Other methods to reduce shrinkage of fabrics, garments, or yarns which do not result in release of damaging substances to the environment have been described, including processes such as low-temperature plasma treatments.

SUMMARY OF THE INVENTION

The object of the present invention is to provide an enzyme-based method for treating fabrics, garments, or yarn, in order to provide advantages with regard to improved bleaching effect, dye uptake, and/or shrink-resistance, and by which methods, it is possible to reduce fiber damage and limit the use of environmentally damaging chemicals.

It has now been found that certain properties of fabrics, garments, or yarn may be improved by subjecting the undyed fabric, garment, or yarn to a treatment with a haloperoxidase together with a hydrogen peroxide source and a halide source in an amount effective for providing the desired effect.

One embodiment of the invention provides a method of manufacturing a bleached fabric, garment or yarn comprising treating undyed fabric, garment or yarn in an aqueous medium with an effective amount of a haloperoxidase, a halide source and a hydrogen peroxide source at a lower temperature typically at 30–70° C. than what is used in a traditional hydrogen peroxide bleaching. This embodiment provides a process for bleaching undyed fabric, garment or yarn at a lower temperature than 100° C., and a bleaching process which requires less chemicals than what is needed today. Another embodiment provides a method of bleaching motes in a cellulosic fabric, garment or yarn comprising treating undyed fabric, garment or yarn in an aqueous medium with an effective amount of a haloperoxidase, a halide source and a hydrogen peroxide source.

Another embodiment of the invention provides a method of manufacturing fabrics, garments, or yarns with improved shrink-resistance or dye uptake. The fabric, garment, or yarn is preferably of wool.

Other aspects of the invention will become apparent from the following detailed description and the claims.

DETAILED DESCRIPTION OF THE INVENTION

Before the methods of the invention are described, it is to be understood that this invention is not limited to the particular methods described. The terminology used herein is for the purpose of describing particular embodiments only, and is not intended to be limiting since the scope of the present invention will be limited only by the appended claims.

As used in this specification and the appended claims, the singular forms "a", "an", and "the" include plural references unless the context clearly dictates otherwise. Thus, for example, references to "haloperoxidase" or "haloperoxidase preparation" include mixtures of such haloperoxidase, reference to "the method" includes one or more methods, and/or steps of the type described herein and/or which will become apparent to those persons skilled in the art upon reading this disclosure and so forth.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described. All publications mentioned herein are incorporated herein by reference for the purpose of disclosing and describing the material for which the reference was cited in connection with.

The term "undyed" refers to fabric, garment, or yarn that has not fully completed a dyeing process. Dyeing may optionally be carried out during or after the method according to the invention. Preferably the enzyme treatment is carried out before the dyeing step.

The term "bleaching" is here defined as a whitening of the fabric, garment, or yarn, and can be measured by using the change in the color space coordinates L*a*b*(CIELAB-system): L* gives the change in white/black at a scale of from 0 to 100. A decrease in L* means an increase in black color (decrease of white color), an increase in L* means an increase in white color (a decrease in black color). Bleaching may also be measured using Stensby units (W=L+3a−3b).

Fabric can be constructed from fibres by weaving, knitting or non-woven operations. Weaving and knitting require yarn as the input whereas a non-woven fabric is the result of random bonding of fibres (paper can be thought of as non-woven).

Woven fabric is constructed by weaving "filling" or weft yarns between wrap yarns stretched in the longitudinal direction on the loom. The wrap yarns must be sized before weaving in order to lubricate and protect them from abrasion at the high speed insertion of the filling yarns during weaving. The filling yarn can be woven through the warp yarns in a "over one—under the next" fashion (plain weave) or by "over one—under two" (twill) or any other myriad of permutations. Strength, texture and pattern are related not only to the type/quality of the yarn but also the type of weave. Generally, dresses, shirts, pants, sheeting's, towels, draperies, etc. are produced from woven fabric.

Knitting is forming a fabric by joining together interlocking loops of yarn. As opposed to weaving which is constructed from two types of yarn and has many "ends", knitted fabric is produced from a single continuous strand of yarn. As with weaving, there are many different ways to loop yarn together and the final fabric properties are dependent both upon the yarn and the type of knit. Underwear, sweaters, socks, sport shirts, sweat shirts, etc. are derived from knit fabrics.

Non-woven fabrics are sheets of fabric made by bonding and/or interlocking fibres and filaments by mechanical, thermal, chemical or solvent-mediated processes. The resultant fabric can be in the form of web-like structures, laminates or films. Typical examples are disposable baby diapers, towels, wipes, surgical gowns, garments for the "environmental friendly" fashion, filter media, bedding, roofing materials, backing for two-dimensional fabrics and many others.

According to the invention, the process may be applied to any fabric known in the art (woven, knitted, or non-woven). In particular the bleaching process may be applied to cellulose-containing or cellulosic fabrics, such as cotton, viscose, rayon, ramie, linen, lyocell (e.g., Tencel, produced by Courtaulds Fibers), or mixtures thereof, or mixtures of any of these fibres, or mixtures of any of these fibres together with synthetic fibres (e.g., polyester, polyamide, nylon) or other natural fibers such as wool and silk. The term "wool" includes any commercially useful animal hair product, for example, wool from sheep, camel, rabbit, goat, or llamas, and includes wool fiber and animal hair. The method of the invention can be used with wool or animal hair material in the form of top, fiber, yarn, or woven or knitted fabric. The enzymatic treatment can also be carried out on loose flock or on garments made from wool or animal hair material.

The treatment can be performed at many different stages of processing.

The term "shrinkage" refers to the felting shrinkage of fibers as defined in IWS TM 31, i.e., felting shrinkage is the irreversible shrinkage caused by progressive entanglement of the wool fibers induced by washing in an aqueous solution, and is defined as the reduction in length and/or width induced by washing. Shrinkage can be measured in accordance with IWS TM 31, or it can be measured using the following modification. Wool samples (24 cm×24 cm) are sewed around the edges and inscribed with a rectangle (18 cm×18 cm). Samples are treated, air-dried, then subjected to five cycles of machine washing and drying (warm wash, high heat of drying) in combination with external ballast such as towels and articles of clothing. The dimensions of the rectangle are measured after five cycles, and the shrinkage is defined as the change in dimensions of the rectangle, after accounting for initial relaxation shrinkage.

The term "shrink-resistance" is a measure of the reduction in shrinkage (as defined above, after wash/dry cycles) for material that has been treated relative to material that has not been treated, i.e., $$\text{Shrink-resistance}=(\text{Shrinkage}_{untreated}-\text{Shrinkage}_{treated})/\text{Shrinkage}_{treated}$$

The value is multiplied by 100 in order to be expressed as a percentage.

The term "dye uptake" refers to properties associated with dyeing of fabrics, garments or yarn such as of wool or animal hair material. Dye uptake is a measure of the capacity of wool or animal hair material immersed in a dye solution to absorb available dyestuff. This property can be measured by the following test. In a suitable reaction vessel, wool or animal hair material is added to a buffered solution of acid black 172 (300 ml of 0.05 M NaOAc buffer, pH 4.5, plus 7.5 mL of a 1.0% w/w solution of acid black 172 in water). The vessel is incubated in a shaking water bath at 50° C. for 15 minutes with mild agitation. After removal of the material from solution, it is allowed to air-dry, then measured in a suitable spectrophotometer to determine CIELAB values. Dye uptake is determined by the L* reading, and changes in dye uptake are found by determining dL* relative to untreated material.

"Mote" particles are dark brown particles found on unbleached cotton fabric, also called "dark spots". They are cotton pod and stem residues originating from the mechanical picking of cotton. The brown color is due to the high lignin content of the mote particles.

Haloperoxidases

In the context of the present invention, the term "haloperoxidase" is intended to mean an enzyme selected from the group consisting of chloride peroxidase (EC 1.11.1.10), bromide peroxidase, and iodide peroxidase (EC 1.11.1.8).

A chloride peroxidase is an enzyme capable of oxidizing chloride, bromide and iodide ions with the consumption of $H_2O_2$.

A bromide peroxidase is an enzyme capable of oxidizing bromide and iodide ions with the consumption of $H_2O_2$.

A iodide peroxidase is an enzyme capable of oxidizing iodide ions with the consumption of $H_2O_2$.

Haloperoxidases form a class of enzymes capable of oxidizing halides (X=Cl—, Br—, or I—) in the presence of hydrogen peroxide to the corresponding hypohalous acid (HOX) according to the equation:

$$H_2O_2+X^-+H^+\rightarrow H_2O+HOX$$

If an appropriate nucleophile is present, a reaction will occur with HOX, whereby bleaching may take place.

Haloperoxidases have been isolated from various organisms: mammals, marine animals, plants, algae, a lichen, fungi and bacteria (for reference see *Biochimica et Biophysica Acta* 1161, 1993, pp. 249–256). It is generally accepted that haloperoxidases are the enzymes responsible for the formation of halogenated compounds in nature, although other enzymes may be involved.

Haloperoxidases have been isolated from many different fungi, in particular from the fungus group dematiaceous hyphomycetes, such as Caldariomyces, e.g., *C. fumago,* Alternaria, Curvularia, e.g., *C. verruculosa* and *C. inaequalis,* Drechslera, Ulocladium and Botrytis (see U.S. Pat. No. 4,937,192).

According to the present invention, a haloperoxidase obtainable from Curvularia, in particular *C. verruculosa,* is preferred. Curvularia haloperoxidase and recombinant production thereof is described in WO 97/04102.

Haloperoxidase has also been isolated from bacteria such as Pseudomonas, e.g., *P. pyrrocinia* (for reference see *The*

*Journal of Biological Chemistry* 263, 1988, pp. 13725–13732) and Streptomyces, e.g., *S. aureofaciens* (for reference see *Structural Biology* 1, 1994, pp. 532–537).

Bromide peroxidase has been isolated from algae (see U.S. Pat. No. 4,937,192).

In use, the concentration of the haloperoxidase may be varied in order to achieve the desired bleaching effect in the desired time frame. However, according to the invention, the haloperoxidase will normally be added in a concentration of 0.01–100 mg enzyme protein per liter, preferably in a concentration of 0.1–50 mg enzyme protein per liter, more preferably in a concentration of 1–10 mg enzyme protein per liter.

Halide Sources

According to the invention, the halide source for the reaction with haloperoxidase may be achieved in many different ways: The halide source may be sodium chloride, potassium chloride, sodium bromide, potassium bromide, sodium iodide, or potassium iodide. The concentration of the halide source will typically correspond to 0.01–1000 mM, preferably in the range of from 0.1–500 mM.

Hydrogen Peroxide Sources

According to the invention, the hydrogen peroxide needed for the reaction with the haloperoxidase may be achieved in many different ways: It may be hydrogen peroxide or a hydrogen peroxide precursor, such as percarbonate or perborate, or a peroxycarboxylic acid or a salt thereof, or it may be a hydrogen peroxide generating enzyme system, such as an oxidase and its substrate. Useful oxidases include glucose oxidase, a glycerol oxidase or an amino acid oxidase. An example of an amino acid oxidase is given in WO 94/25574.

According to the invention, the hydrogen peroxide source needed for the reaction with the haloperoxidase may be added in a concentration corresponding to a hydrogen peroxide concentration in the range of from 0.01–1000 mM, preferably in the range of from 0.1–500 mM.

Process

The chosen procedure will depend on the haloperoxidase in question, regarding pH optimum, temperature optimum, etc.

If a haloperoxidase from Curvularia verruculosa is used, the processing conditions could be: 30–70° C., pH 5, using 1–5 mg enzyme/liter, 50–500 mM halide (e.g. sodium chloride), 20 mM hydrogen peroxide, at a liquor/fabric ratio of from 4:1–30:1, for a reaction time of 30–120 min. (as illustrated in Example 1).

A buffer may be added to the reaction medium to maintain a suitable pH for the haloperoxidase used. The buffer may suitably be a phosphate, borate, citrate, acetate, adipate, triethanolamine, monoethanolamine, diethanolamine, carbonate (especially alkali metal or alkaline earth metal, in particular sodium or potassium carbonate, or ammonium and HCl salts), diamine, especially diaminoethane, imidazole, or amino acid buffer.

The process of the invention may be carried out in the presence of conventional fabric, garment, or yarn finishing agents, including wetting agents, polymeric agents, dispersing agents, etc.

A conventional wetting agent may be used to improve the contact between the substrate and the enzyme used in the process. The wetting agent may be a nonionic surfactant, e.g., an ethoxylated fatty alcohol. A very useful wetting agent is an ethoxylated and propoxylated fatty acid ester such as Berol 087 (product of Akzo Nobel, Sweden).

Examples of suitable polymers include proteins (e.g., bovine serum albumin, whey, casein or legume proteins), protein hydrolysates (e.g., whey, casein or soy protein hydrolysate), polypeptides, lignosulfonates, polysaccharides and derivatives thereof, polyethylene glycol, polypropylene glycol, polyvinyl pyrrolidone, ethylene diamine condensed with ethylene or propylene oxide, ethoxylated polyamines, or ethoxylated amine polymers.

The dispersing agent may suitably be selected from nonionic, anionic, cationic, ampholytic or zwitterionic surfactants. More specifically, the dispersing agent may be selected from carboxymethylcellulose, hydroxypropylcellulose, alkyl aryl sulphonates, long-chain alcohol sulphates (primary and secondary alkyl sulphates), sulphonated olefins, sulphated monoglycerides, sulphated ethers, sulphosuccinates, sulphonated methyl ethers, alkane sulphonates, phosphate esters, alkyl isothionates, acylsarcosides, alkyltaurides, fluorosurfactants, fatty alcohol and alkylphenol condensates, fatty acid condensates, condensates of ethylene oxide with an amine, condensates of ethylene oxide with an amide, sucrose esters, sorbitan esters, alkyloamides, fatty amine oxides, ethoxylated monoamines, ethoxylated diamines, alcohol ethoxylate and mixtures thereof. A very useful dispersing agent is an alcohol ethoxylate such as Berol 08 (product of Akzo Nobel, Sweden).

The bleaching processing may be performed in any machinery known in the art.

Inactivation of the haloperoxidase in question will normally not be necessary; however if an inactivation of the enzyme is wanted it may be performed as known in the art, e.g., high temperature and/or high pH, but the specific inactivation conditions will of course depend on the enzyme in use.

The fabric may be further finished by one or more of the following treatments as known in the art: dyeing, biopolishing, brightening, softening, and/or anti-wrinkling treatment(s).

Test Procedure

The test procedure for fabric bleaching may be performed visually and by using a Minolta Chroma Meter CR200, a Minolta Chroma Meter CR300 or a Minolta Chroma Meter 508i.

Evaluation: A Minolta Chroma Meter (available from Minolta Corp.) is used according to Manufacturer's instructions to evaluate the degree of bleaching as well as to estimate any discoloration using the change in the color space coordinates L*a*b* (CIELAB-system) : L* gives the change in white/black at a scale of from 0 to 100, a gives the change in green (−a*)/red (+a*), and b* gives the change in blue (−b*) /yellow (+b*) . A decrease in L* means an increase in black color (decrease of white color), an increase in L* means an increase in white color (a decrease in black color), a decrease in a* means an increase in green color (decrease in red color), an increase in a* means an increase in red color (a decrease in green color), a decrease in b* means an increase in blue color (a decrease in yellow color), and an increase in b* means an increase in yellow color (a decrease in blue color).

The instrument is calibrated using a standard calibration plate (white).

The invention is further illustrated in the following examples, which are not intended to be in any way limiting to the scope of the invention as claimed.

EXAMPLE 1

Bleaching of raw cotton swatches with *Curvularia verruculosa* haloperoxidase

Experimental conditions

The bleaching system contained 3 mg/l recombinant *Curvularia verruculosa* haloperoxidase with [NaCl]=100 mM as substrate and $[H_2O_2]$=20 mM as donor. pH was adjusted to pH=5.

The swatches were bleached for 60 minutes at 40° C. (The enzyme was produced as described in WO 97/04102).

The bleaching system was tested on twill cotton swatches and woven cotton swatches.

For twill fabric the fabric/liquor ratio was: 1 g of fabric in 15 ml of aqueous medium.

For woven fabric the fabric/liquor ratio was: 1 g of fabric in 20 ml of aqueous medium.

Results

Significant visual bleaching was obtained with the experimental conditions described above.

Note that the blind test assures that the observed bleaching effect is enzymatic in nature.

The bleaching results are presented in the Table 1 below:

| ΔL*/Δa*/Δb* on raw cotton swatches[a]. | | |
|---|---|---|
| Bleaching system | Twill[b] | Woven[b] |
| Blind[c] | (−)0.2/0.1/0.0 | (−)0.2/0.0/(−)0.1 |
| Enzyme[d] | 2.5/(−)0.9/(−)1.5 | 1.6/(−)0.6/(−)1.3 |

[a]Measurements were all done on a Minolta 508i. Lamp was set to D65 and 2°.
[b]Desized swatches obtained from Test Fabrics.
[c]System consists of NaCl, hydrogen peroxide and acetate buffer.
[d]System consists of haloperoxidase, NaCl, hydrogen peroxide and acetate buffer.

EXAMPLE 2

Bleaching of motes with *Curvularia verruculosa* haloperoxidase

Experimental conditions

The bleaching system was the same as described in Example 1: 3 mg/l recombinant *Curvularia verruculosa* haloperoxidase with [NaCl]=100 mM as substrate and $[H_2O_2]$=20 mM as donor. pH was adjusted to pH=5.

The swatches were bleached for 60 minutes at 40° C. in an Atlas LP2 Lauder-o-meter. Linen woven 100% cotton was supplied by Nordisk Textil Væveri & Trykkeri A/S. The fabric/liquor ratio was 1 g of fabric in 20 ml of aqueous medium.

Results

Motes were counted on a fabric area of 10 cm×15 cm (on both sides).

A mote was defined as a "dark spot" on the cotton surface irrespective of size.

Double determination of the mote bleaching effect was carried out.

The numbers 1 and 2 in Table 2 refer to the separate fabric cloths used.

Note that a positive difference in mote count can be due to the motes splitting up due to the mechanical handling of the fabric cloth.

TABLE 2

| | Mote count before bleaching | | Mote count after bleaching | | Difference in mote count | |
|---|---|---|---|---|---|---|
| Side of fabric cloth | Side 1 | Side 2 | Side 1 | Side 2 | Side 1 | Side 2 |
| Reference 1[a] | 85 | 74 | 91 | 71 | +6 | −3 |
| Reference 2[a] | 78 | 68 | 69 | 70 | −9 | +2 |

TABLE 2-continued

| | Mote count before bleaching | | Mote count after bleaching | | Difference in mote count | |
|---|---|---|---|---|---|---|
| Side of fabric cloth | Side 1 | Side 2 | Side 1 | Side 2 | Side 1 | Side 2 |
| Blind 1[b] | 60 | 50 | 62 | 52 | +2 | +2 |
| Blind 2[b] | 72 | 74 | 77 | 75 | +5 | +1 |
| Enzymatic 1[c] | 53 | 62 | 49 | 42 | −4 | −20 |
| Enzymatic 2[c] | 68 | 62 | 41 | 56 | −27 | −6 |

[a]Fabric washed in buffer only.
[b]Conditions as described above in the experimental section but without added enzyme.
[c]Conditions as described above in the experimental section.

The reference tests illustrate the effects of the mechanical washing procedure and as can be seen from Table 2, the loss of motes is ambiguous. (The mechanical washing procedure has no significant effect on the number of motes left on the cloth after the bleaching.)

Table 2 shows that there is a significant loss of motes when submitting the fabric cloth to the enzymatic bleaching conditions. The blind test assures that the observed effect is enzymatic in nature.

EXAMPLE 3

Treatment of wool with *Curvularia verruculosa* haloperoxidase

Experimental conditions

The enzyme system was the same as described in Example 1: 3 mg/l recombinant *Curvularia verruculosa* haloperoxidase with [NaCl]=100 mM as substrate and $[H_2O_2]$=20 mM as donor. pH was adjusted to pH=5.

Swatches (24 cm×24 cm, approx. 10 g each) of TF532 Jersey Knit Wool were cut and sewn around the edge with a surger. A permanent marker was used to draw an 18×18 rectangle on each swatch.

| Results: | |
|---|---|
| Treatment | Shrinkage (%) |
| Blind | 29 |
| Enzymatic | 23 |

We claim:

1. A method of pretreating raw cotton or wool to improve shrink-resistance, comprising treating fabrics, garments, or yarns of raw cotton or wool in an aqueous medium with an effective amount of a haloperoxidase, a halide source and a hydrogen peroxide source, wherein the pretreated raw cotton or wool exhibits improved shrink-resistance relative to untreated raw cotton or wool.

2. The method of claim 1, wherein the haloperoxidase is obtainable from fungi, from bacteria, or from algae.

3. The method of claim 2, wherein the haloperoxidase is obtainable from a fungus selected from the group consisting of Caldariomyces, Alternaria, Curvularia, Drechslera, Ulocladium and Botrytis.

4. The method of claim 3, wherein the haloperoxidase is obtainable from Curvularia.

5. The method of claim 4, wherein the haloperoxidase is obtainable from *Curvularia verruculosa*.

6. The method of claim 2, wherein the haloperoxidase is obtainable from a bacterium selected from the group consisting of Pseudomonas and Streptomyces.

7. The method of claim 1, wherein haloperoxidase is present in a concentration range of from 0.01–100 mg enzyme protein per liter.

8. The method of claim 1, wherein the halide source is sodium chloride, potassium chloride, sodium bromide, potassium bromide, sodium iodide, or potassium iodide.

9. The method of claim 8, wherein the halide source in present in a concentration corresponding to 0.01–1000 mM.

10. The method of claim 1, wherein the source of hydrogen peroxide is hydrogen peroxide, or a hydrogen peroxide precursor, or a hydrogen peroxide generating enzyme system.

11. The method of claim 10, wherein the hydrogen peroxide precursor is one of percarbonate or perborate.

12. The method of claim 10, wherein the hydrogen peroxide generating enzyme system is an oxidase and its substrate, or a peroxycarboxylic acid or a salt thereof.

13. The method of claim 10, wherein the hydrogen peroxide source corresponds to a hydrogen peroxide concentration in the range of from 0.01–1000 mM.

14. The method of claim 1, wherein the haloperoxidase is applied at a temperature below 70° C.

15. The method of claim 1, wherein the aqueous medium contains a surfactant.

16. A method of manufacturing fabrics, garments, or yarns from raw cotton or wool with improved shrink-resistance comprising treating raw cotton or wool with an effective amount of a haloperoxidase, a halide source and a hydrogen peroxide source in an aqueous medium, wherein the pretreated raw cotton or wool exhibits improved shrink-resistance relative to untreated raw cotton or wool.

* * * * *